US006896130B2

(12) United States Patent
Theelen

(10) Patent No.: US 6,896,130 B2
(45) Date of Patent: May 24, 2005

(54) PAPERBOARD CARTON

(75) Inventor: Marcus Theelen, Kreuzau-Winden (DE)

(73) Assignee: Graphic Packaging International, Inc., Marietta, GA (US)

( * ) Notice: Subject to any disclaimer, the term of this patent is extended or adjusted under 35 U.S.C. 154(b) by 24 days.

(21) Appl. No.: 10/355,929

(22) Filed: Jan. 31, 2003

(65) Prior Publication Data

US 2004/0011674 A1 Jan. 22, 2004

(30) Foreign Application Priority Data

Feb. 7, 2002 (GB) ..... 0202809

(51) Int. Cl.[7] ..... B65D 71/00
(52) U.S. Cl. ..... 206/175; 206/141; 206/163
(58) Field of Search ..... 206/141, 163, 206/165, 166, 162, 170, 174, 175, 200

(56) References Cited

U.S. PATENT DOCUMENTS 2,375,631 A * 5/1945 De Villard ..... 206/194
3,353,709 A * 11/1967 Lawrence ..... 206/141
4,034,852 A * 7/1977 Forrer ..... 206/141
4,470,503 A 9/1984 Stone ..... 206/141
4,637,515 A * 1/1987 Wilson et al. ..... 206/434
4,747,534 A * 5/1988 Marie ..... 229/117.12
5,595,291 A * 1/1997 Negelen ..... 206/143
5,819,920 A * 10/1998 Sutherland ..... 206/174
6,695,137 B2 * 2/2004 Jones et al. ..... 206/166

FOREIGN PATENT DOCUMENTS

| | | | |
|---|---|---|---|
| GB | 1101345 | 1/1968 | ..... B65B/11/48 |
| GB | 2202825 | 10/1988 | ..... B65D/5/50 |
| GB | 2209515 | 5/1989 | ..... B65D/71/00 |

* cited by examiner

*Primary Examiner*—John A. Ricci
(74) *Attorney, Agent, or Firm*—Womble Carlyle Sandridge & Rice, PLLC

(57) ABSTRACT

There is provided a carton 11 for containing two rows of bottles 12. The carton has a base, a pair of oppositely disposed side walls and a top panel section. The top panel section has side areas 22, 32 which lie over the tops of the bottles 12 and a central area 26, 35 between the bottles which is at least partially depressed relative to the side areas 22, 32. A handle portion can extend between the side panels and is constituted by opposite side areas 22 being linked together by central area 26 and handle web panels 24. The handle portion can be lifted from the depressed position into a raised carrying position.

22 Claims, 4 Drawing Sheets

PAPERBOARD CARTON

RELATED APPLICATION

This application claims priority under 35 U.S.C. §119(b) to British application serial no. 0202809.0, filed on Feb. 7, 2002.

FIELD OF THE INVENTION

The present invention relates to paperboard cartons and more particularly to cartons for retaining as a multipack a plurality of articles which are narrower at their top, such as bottles.

SUMMARY OF THE INVENTION

According to the present invention there is provided a paperboard carton for a plurality of bottles arranged in at least two lengthwise extending rows, the carton having a base, a pair of oppositely disposed side panels and a top panel section which is hingedly connected at opposite sides to the upper edges of the side panels, the top panel section having side areas adjacent the side panels for lying against the tops of the bottles and a central area which is at least partially depressed relative to said side areas.

Preferably the top panel section comprises a central handle portion which extends laterally from one side panel to the other side panel and which can be moved between a raised carrying position and a lowered stored position. Another preferred feature is that the top panel section further comprises an end portion at each lengthwise end of the carton, said end portions extending between the first and second side panels and providing said side and central areas.

In certain embodiments the carton is for two rows of bottles and the central area has a pair of web panels at each side which are connected by means of respective folds to the adjacent side areas and has a central panel connected to the respective web panels by means of reverse folds, such that in use the web panels extend downwardly and the central panel is lower than the side areas. Often the junction between each side area and its adjacent web panel includes at least one cut away portion for receiving a side portion of a bottle closure.

Conveniently the width of the base between the side panels is substantially equal to the combined width of the side areas, web panels and central panel such that when the central panel is moved into its lowered position, the top side edges move inwardly. Ideally the top edge of each side panel lies generally adjacent the bottle closures.

It is a preferred feature that the central handle portion has a pair of handle side areas adjacent the respective side panels for lying against the tops of the bottles, a pair of handle web panels which are connected by means of respective folds to the adjacent handle side areas and a central handle panel connected to the handle web panels by respective reverse folds. Preferably cuts define the edges of the handle side areas and said cuts extend partway into the side panels.

With some arrangements the handle side areas have a greater lateral width than the side areas of the end portions and the handle web panels are of a lesser depth than the web panels of the end portions, such that the central handle panel when in its stored position is higher than the central panels of the end portions. Also, the central handle panel has foldable tuck panels at each lengthwise end.

In some embodiments an end panel is foldably connected to each end of the base. With these embodiments it is a preferred feature that each end panel is secured to extension panels which are hingedly connected to the side panels and which are folded inwardly across the ends of the carton.

BRIEF DESCRIPTION OF THE DRAWINGS

Embodiments of the present invention will now be described in more detail. The description makes reference to the accompanying drawings in which.

DETAILED DESCRIPTION

Figure 1:
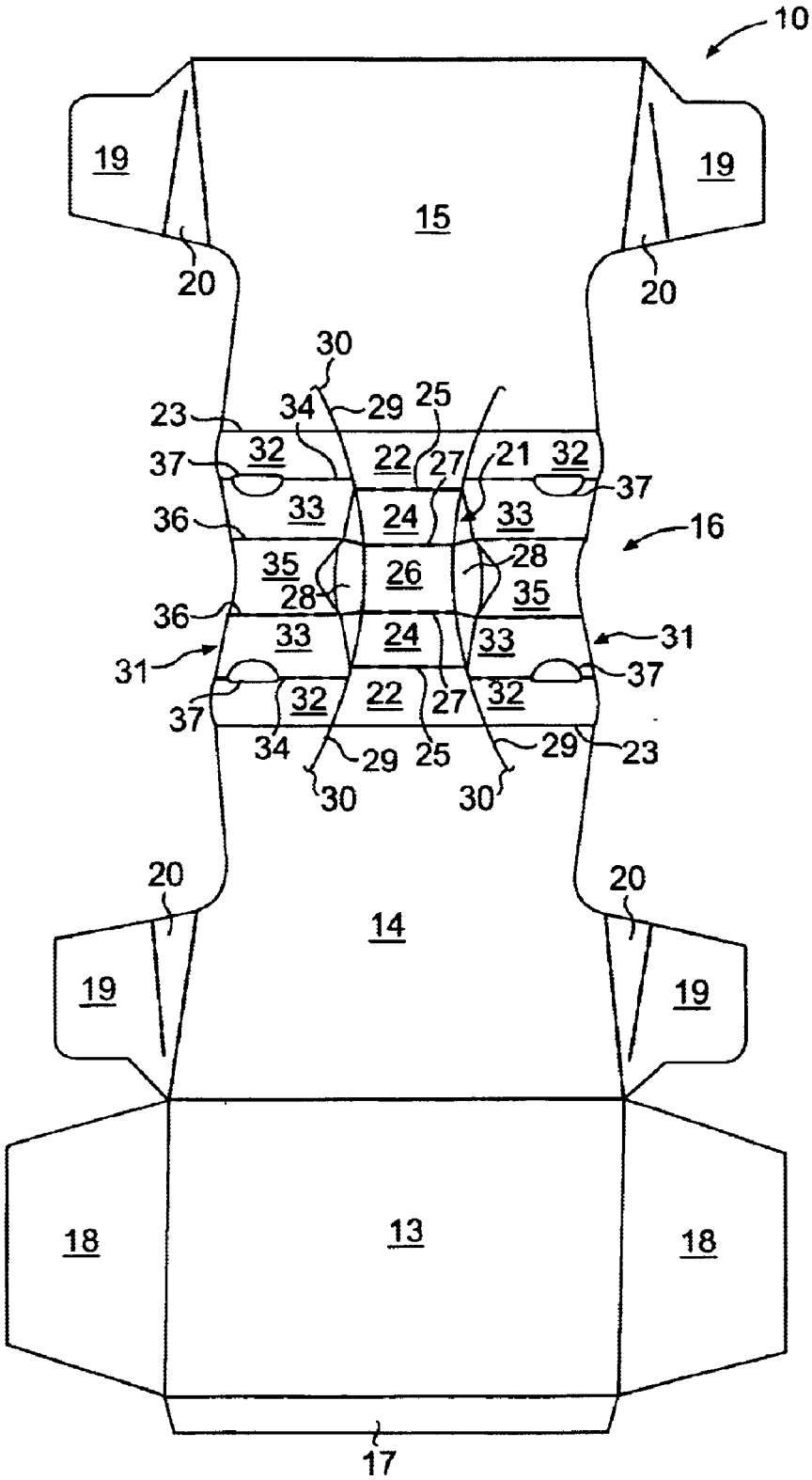
FIG. 1 shows a paperboard blank for producing a carton according to the present invention.

In the figures there is shown a paperboard blank 10 for forming a carton 11 for retaining as a multipack six bottles 12 in two lengthwise extending rows of three. This type of carton 11 is ideally suited to bottles, but it will be appreciated that other articles which are narrower at their top could be substituted.

The blank 10 provides a base 13, first and second side panels 14, 15 and a top panel section 16. A securing panel 17 is also provided for adhesive attachment to the second side panel 15. End panels 18 are hingedly connected to the base 13 at opposite ends and end extension panels 19 are hingedly connected at the ends of each side panel 14, 15 for attachment to the end panels 18. In this particular embodiment, intermediate angled gusset panels 20 are provided between the extension panels 19 and the side panels 14, 15 to ensure a snug fit of the panels around the outermost contours of the end bottles 12.

The top panel section 16 comprises a central handle portion 21 which extends laterally between the two side panels 14, 15. The central handle portion 21 has a pair of oppositely disposed handle side areas 22 which are hingedly connected to the top edges 23 of the respective side panels 14, 15. Handle web panels 24 are hingedly connected to the handle side areas 22 by means of folds 25. A central handle panel 26 is hingedly connected by reverse folds 27 to the web panels 24. Tuck panels 28 are provided at opposite sides of the central handle panel 26 so as to aid comfort of the handle in use by being folded under the central handle panel 26. Cuts 29 define the edges of the handle side areas 22 and extend a short distance into the adjacent side panels 14, 15. The cuts 29 each have a stress-relieving curve 30 at the lowermost end.

On either side of the central handle portion 21 the top panel section 16 has an end portion 31. Each end portion 31 has a pair of oppositely disposed side areas 32, a pair of web panels 33 hingedly connected by folds 34 to the side areas 32 and a central area 35 hingedly connected by reverse folds 36 to the web panels 33. At the junctions of the web panels 33 and the side areas 32 are openings 37 for receiving, in use, the edges of bottle closures.

Figure 2:
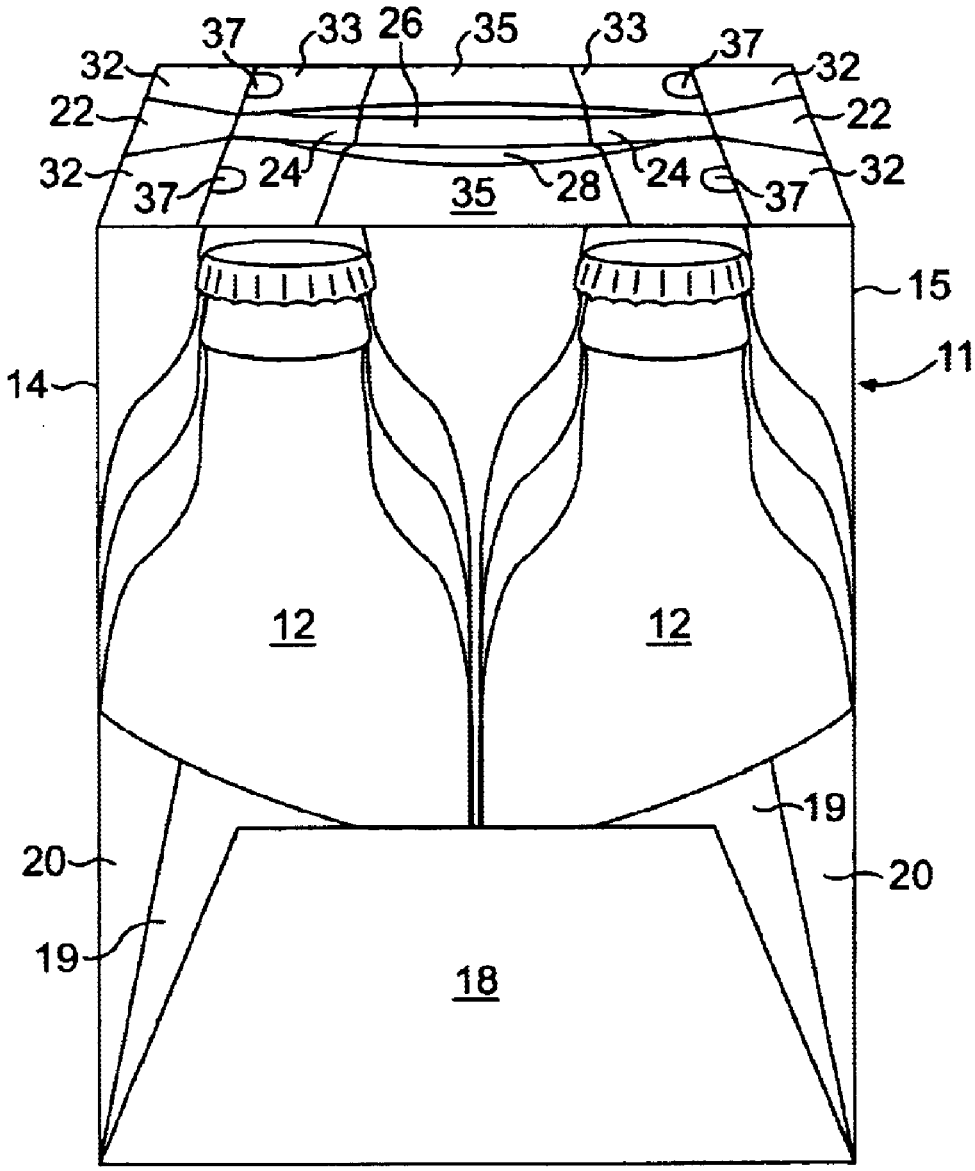
FIG. 2 is an end perspective view of the carton in part assembled form.
Figure 3:
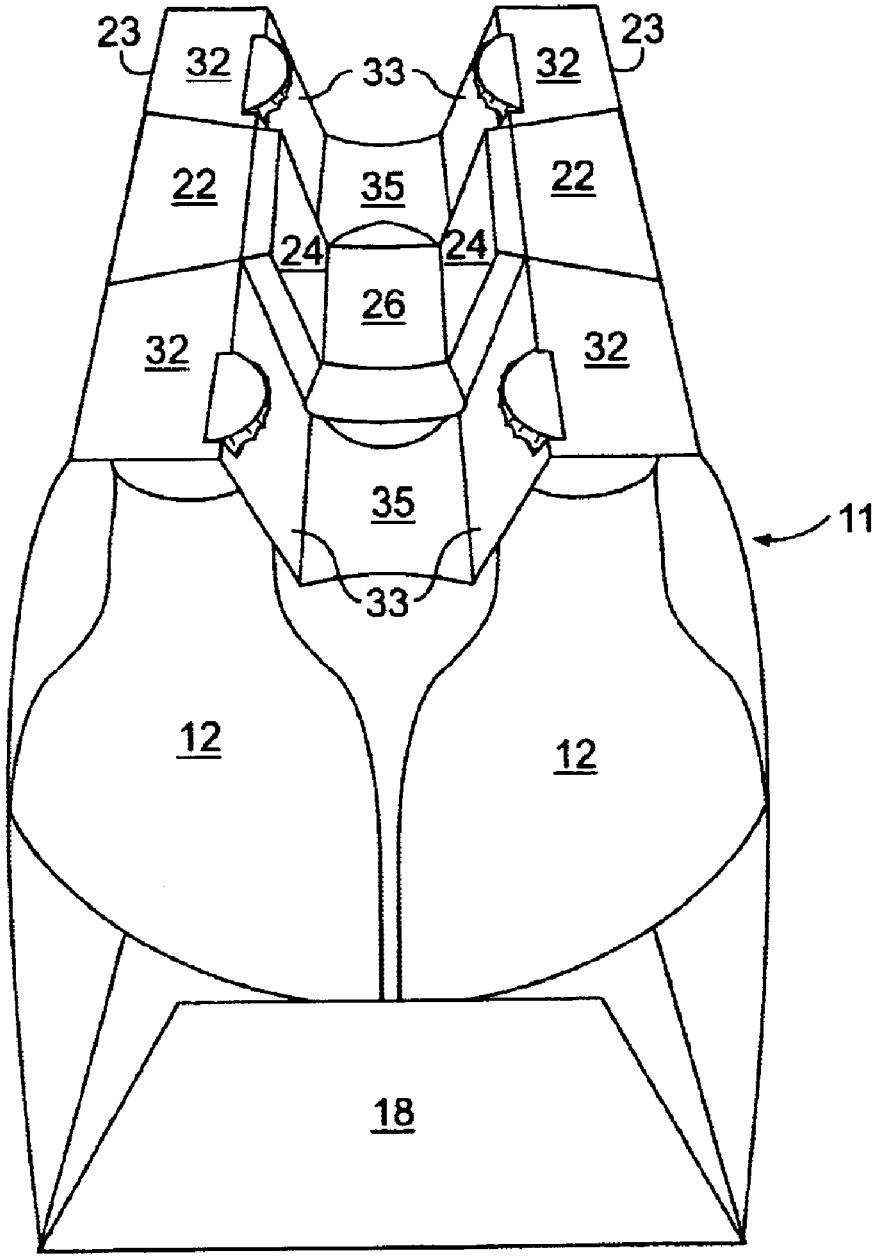
FIG. 3 is an end perspective view of the carton in a fully assembled, stored form.
Figure 4:
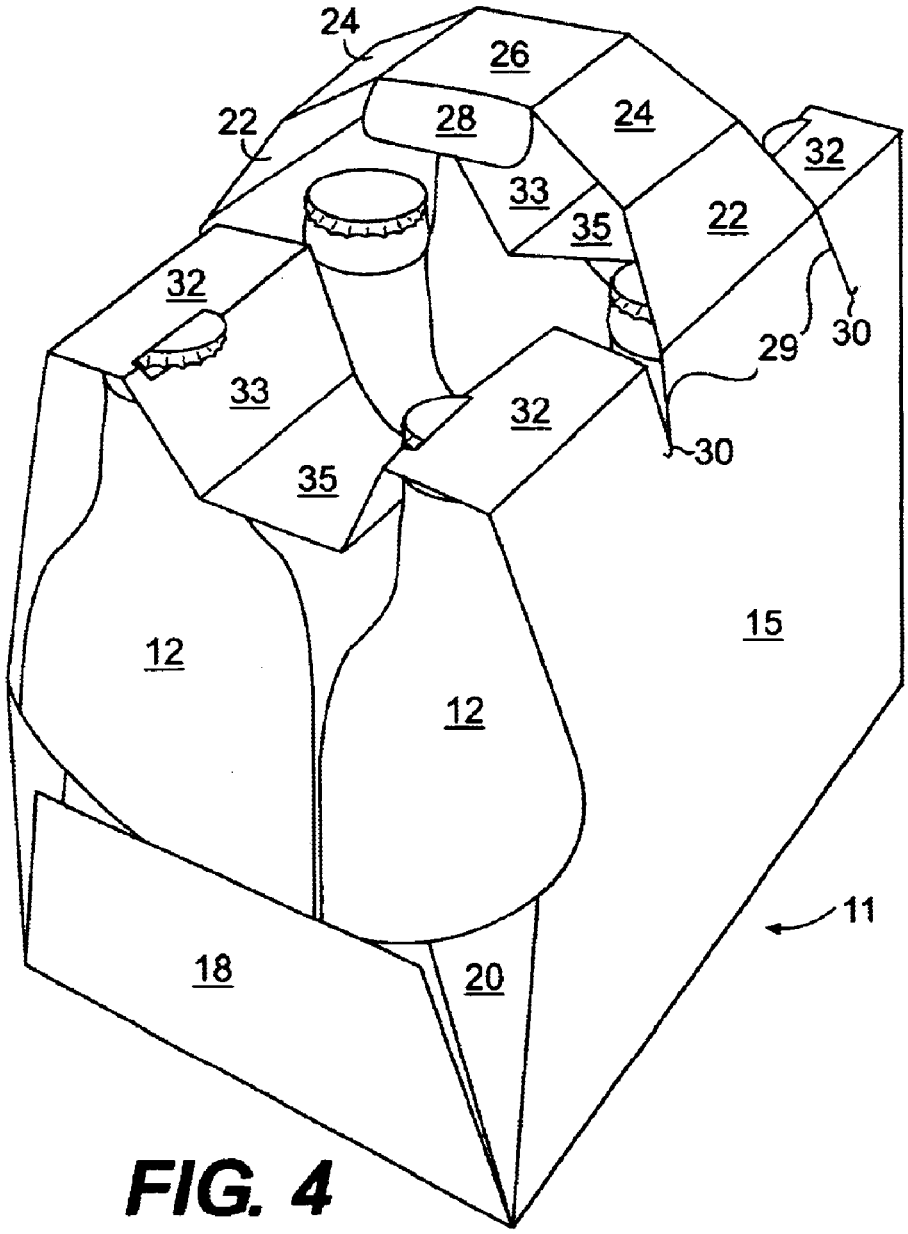
FIG. 4 is a side perspective view of the assembled carton in a carrying position.

The lateral distance between the top edges 23 of the blank 10 is substantially equal to the lateral width of the base 13 such that basic folding of the blank 10 around the group of six bottles and gluing of adhesive panel 17 and end panels 18 results in the part-assembled arrangement shown in FIG. 2. In this part-assembled form which can be effected on a standard apparatus for forming a fully enclosed pack, the pack lacks rigidity around the tops of the bottles 12.

The top panel 16 has, therefore, been modified so as to be different from the flat top panel of a standard pack. The folds 25, 35 and reverse folds 27, 36 enable the central handle portion 21 and the central areas 35 of the end portions 31 to be pushed downwardly relative to the closures of the bottles 12. This has the effect of drawing the top portions of the side panels 14, 15 inwards until the top edges 23 of the side panels 14, 15 lie close to the bottle closures with the side areas 22, 32 lying on top of the bottle closures. Simultaneously, the web panels 24, 33 hinge downwardly to enable the central portion 21 and central areas 35 to occupy depressed positions. Also, this rotation of the web panels 33 causes the bottle closures to engage in the openings 37. The pack 11 is thus fully assembled and provides good rigidity and integrity, especially around the tops of the bottles 12.

It will be seen that the distance between the pair of folds 25 is less than that between the folds 34, such that the depth of the central web panels 24 is less than that of the end web panels 33. This means that in the initial fully assembled form the central handle panel 26 is slightly less depressed than the central areas 35 of the end portions 31. This means that the central handle is easier to grasp when the user wishes to lift the handle and carry the pack 11.

When the handle portion 21 is lifted, the folds 23, 25, 27 enable the central handle panel 26, the web panels 24 and the side areas 22 to lift clear of the remainder of the pack.

In the arrangement shown, the cuts 29 are provided with frangible bridges which break when the handle is lifted. Frangible bridges are also provided at the comers of the tuck panels 28 so that they are joined to the central areas 35 of the end portions 31 prior to the handle being lifted. These bridges are optional, but do provide greater pack integrity during and after assembly. It will be clear that even when the handle is lifted the end portions 31 retain their close engagement with the bottles.

It will be appreciated that the end panels 18, 19 are optional and could be replaced with other formations for engaging the heels of the bottles 12. Also more bottles could be provided in each row. In some arrangements it may also be possible to accommodate more than two rows of bottles with a depressed section of the top panel being provided between each pair of adjacent rows of bottles.

While preferred embodiments of the invention have been disclosed in the foregoing specification, it will be understood by those skilled in the art that variations and modifications can be made thereto without departing from the spirit and scope of the invention as set forth in the following claims.

What is claimed is:

1. A paperboard carton for a plurality of bottles arranged in at least two lengthwise extending rows, the carton having a base, a pair of oppositely disposed side panels and a top panel section which is hingedly connected at opposite side to the upper edges of the side panels, the top panel section having side areas adjacent the side panels for lying against the tops of the bottles, a central area which is at least partially depressed relative to said side areas, and a central handle portion which extends laterally from one side panel to the other side panel and which can be moved between a raised carrying position and a lowered stored position.

2. A paperboard carton as claimed in claim 1 wherein the top panel section further comprises an end portion at each lengthwise end of the carton, said end portions extending between the first and second side panels and providing said side and central areas.

3. A paperboard carton as claimed in claim 2 wherein the carton is for two rows of bottles and the central area has a pair of web panels at each side which are connected by means of respective folds to the adjacent aide areas and has a central panel connected to the respective web panels by means of reverse folds, such that in use the web panels extend downwardly and the central panel is lower than the side areas.

4. A paperboard carton as claimed in claim 3 wherein the junction between each side area and its adjacent web panel includes at least one cut away portion for receiving a side portion of a bottle closure.

5. A paperboard carton as claimed in claim 3 wherein the width of the base between the side panels is substantially equal to the combined width of the side areas, web panels and central panel of each end portion such that when the central panel is moved into its lowered position, the top side edges move inwardly.

6. A paperboard carton as claimed in claim 5 wherein the top edge of each side panel lies generally adjacent the bottle closures.

7. A paperboard carton as claimed in claim 3 wherein the central handle portion has a pair of handle side areas adjacent the respective side panels for lying against the tops of the bottles, a pair of handle web panels which are connected by means of respective folds to the adjacent handle side areas and a ventral handle panel connected to the handle web panels by respective reverse folds.

8. A paperboard carton as claimed in claim 7 wherein cuts define the edges of the handle side areas and said cuts extend partway into the side panels.

9. A paperboard carton as claimed in claim 7 wherein the handle side areas have a greater lateral width than the side areas of the end portions and the handle web panels are of a lesser depth than the web panels of the end portions, such that the central handle panel when its stored position is higher than the central panels of the end portions.

10. A paperboard carton as claimed in claim 7 wherein the central handle panel has foldable truck panel at each lengthwise end.

11. A paperboard carton for a plurality of bottles arranged in at least two lengthwise extending rows, the carton having a base, a pair of oppositely disposed side panels, a top panel section hingedly connected at opposite sides to the upper edges of the side panels, the top panel section having side areas adjacent the side panels for lying against the tops of the bottles and a central area which is at least partially depressed relative to said side areas, and an end panel foldably connected to each end of the base.

12. A paperboard carton as claimed in claim 11 wherein each end panel is secured to extension panels which are hingedly connected to the side panels and which are folded inwardly across the ends of the carton.

13. A paperboard carton as claimed in claim 11 wherein the top panel section comprises an end portion at each lengthwise end of the carton, each end portion extending between the first and second side panels and providing the side and central areas.

14. A paperboard carton as claimed in claim 11 wherein the carton is for two rows of bottles and the central area has a pair of web panels at each side which are connected by means of respective folds to the adjacent side areas and has a central panel connected to the respective web panels by means of reverse folds, such that in use the web panels extend downwardly and the central panel is lower than the side areas.

15. A paperboard carton as claimed in claim 14 wherein the junction between each side area and its adjacent web panel includes at least one cut away portion for receiving a side portion of a bottle closure.

16. A paperboard carton as claimed in claim 14 wherein the top edge of each side panel lies generally adjacent the bottle closure.

17. A paperboard carton as claimed in claim 14 wherein the width of the base between the side panels is substantially equal to the combined width of the side areas, web panels, and central panel of each end portion such that when the central panel is moved into its lowered position, the top side edges move inwardly.

18. A paperboard carton as claimed in claim 11 wherein the top panel section comprises a central handle portion which extends laterally from one side panel to the other side panel and which can be moved between a raised carrying position and a lowered stored position.

19. A paperboard carton as claimed in claim 18 wherein the central handle portion has a pair of handle side areas adjacent the respective side panels for lying against the tops of the bottles, a pair of handle web panels which are connected by means of respective folds to the adjacent handle side areas and a central handle panel connected to the handle web panels by respective reverse folds.

20. A paperboard carton as claimed in claim 19 wherein cuts define the edges of the handle side areas and said cuts extend partway into the side panels.

21. A paperboard carton as claimed in claim 19 wherein the handle side areas have a greater lateral width than the side areas of the end portions and the handle web panels are of a lesser depth than the web panels of the end portions, such that the central handle panel when its stored position is higher than the central panels of the end portions.

22. A paperboard carton as claimed in claim 18 wherein the central handle panel has foldable truck panels at each lengthwise end.

* * * * *